US005772563A

United States Patent [19]

Lin

[11] Patent Number: 5,772,563

[45] Date of Patent: Jun. 30, 1998

[54] MULTIPURPOSE EXERCISER

[76] Inventor: I-Shun Lin, No. 4, Lane 39, Sec. 2, Chang An Rd., Lu Chu Hsiang, Tao Yuan Hsien, Taiwan

[21] Appl. No.: 844,334

[22] Filed: Apr. 18, 1997

[51] Int. Cl.[6] ..... A63B 23/02

[52] U.S. Cl. ..... 482/140; 482/130; 482/121

[58] Field of Search ..... 482/140, 130, 482/132, 72, 121–123, 124, 127, 133

[56] References Cited

U.S. PATENT DOCUMENTS

| | | | |
|---|---|---|---|
| 5,458,549 | 10/1995 | Obery | 482/140 |
| 5,492,520 | 2/1996 | Brown | 482/140 |
| 5,545,114 | 8/1996 | Gvoich | 482/140 |
| 5,591,111 | 1/1997 | Wang et al. | 482/140 |
| 5,599,261 | 2/1997 | Easley et al. | 482/140 |
| 5,697,874 | 12/1997 | Abelbeck | 482/140 |

*Primary Examiner*—Jerome Donnelly
*Attorney, Agent, or Firm*—Rosenberg, Klein & Bilker

[57] ABSTRACT

A multipurpose exerciser is provided that is formed from two pivotally connected n-shaped frames and an adjustable crossbar extending between one of the n-shaped frames near two ends thereof. Foam rubber material is wrapped around the two n-shaped frames and the adjustable crossbar. One of the n-shaped frames is a primary frame which has a middle portion forming a handle for a user to grip. The adjustable crossbar is provided with two loop-shaped straps at the two outer ends thereof for putting over different areas of the user's body for safety purposes. The two n-shaped frames are angularly adjustable relative to each other, to permit the user to do different exercises with the exerciser by applying force to the primary frame. The exerciser can be used for abdominal exercises, rowing exercises, chest and arm exercises, etc.

3 Claims, 10 Drawing Sheets

MULTIPURPOSE EXERCISER

BACKGROUND OF THE INVENTION

The present invention relates to a multipurpose exerciser which has a simple structure and occupies a small space. The present invention can be used to do more than one type of exercise, including abdominal exercises, rowing exercises, chest and arm exercises, etc.

Due to the limited number of places available for participating in outdoor sports and exercises, people have gradually tended to do more indoor activities and exercises, and look for exercisers that are suitable for that purpose. Since the use of an indoor exerciser has a close relationship to the convenience and safety of the user, there is no doubt that an indoor exerciser must be practical to use.

For most conventional indoor exercisers, including the abdominal exerciser, rowing exerciser, chest and arm exerciser, a considerably large space is usually required to accommodate and position their bulky structure which is not acceptable nor welcomed by the general public. It is therefore desired to improve the conventional indoor exercisers to meet the needs of the general public.

SUMMARY OF THE INVENTION

A primary object of the present invention is to provide a multipurpose exerciser including two pivotally connected n-shaped frames, that is, a primary and a secondary frame. The two n-shaped frames and an adjustable crossbar extending between two ends of the secondary frame, near the two joints of the two frames, are wrapped with a piece of foam rubber cushion. The primary n-shaped frame is provided with a handle portion and two springs. Two loop-shaped straps are connected to end portions of the adjustable crossbar. To use the exerciser of the present invention, the two n-shaped frames are adjusted to provide a suitable angle between them, and then the loop-shaped straps are put over suitable areas of the user's body, as shown in FIGS. 7, 8, 9 and 10, so that a desired exercise can be performed with the multipurpose exerciser by applying a force on the primary n-shaped frame. Many different exercises can be performed through the present invention, including abdominal exercises, chest and arm exercises, rowing exercises, etc.

DETAILED DESCRIPTION OF THE PREFERRD EMBODIMENT

Figure 1:
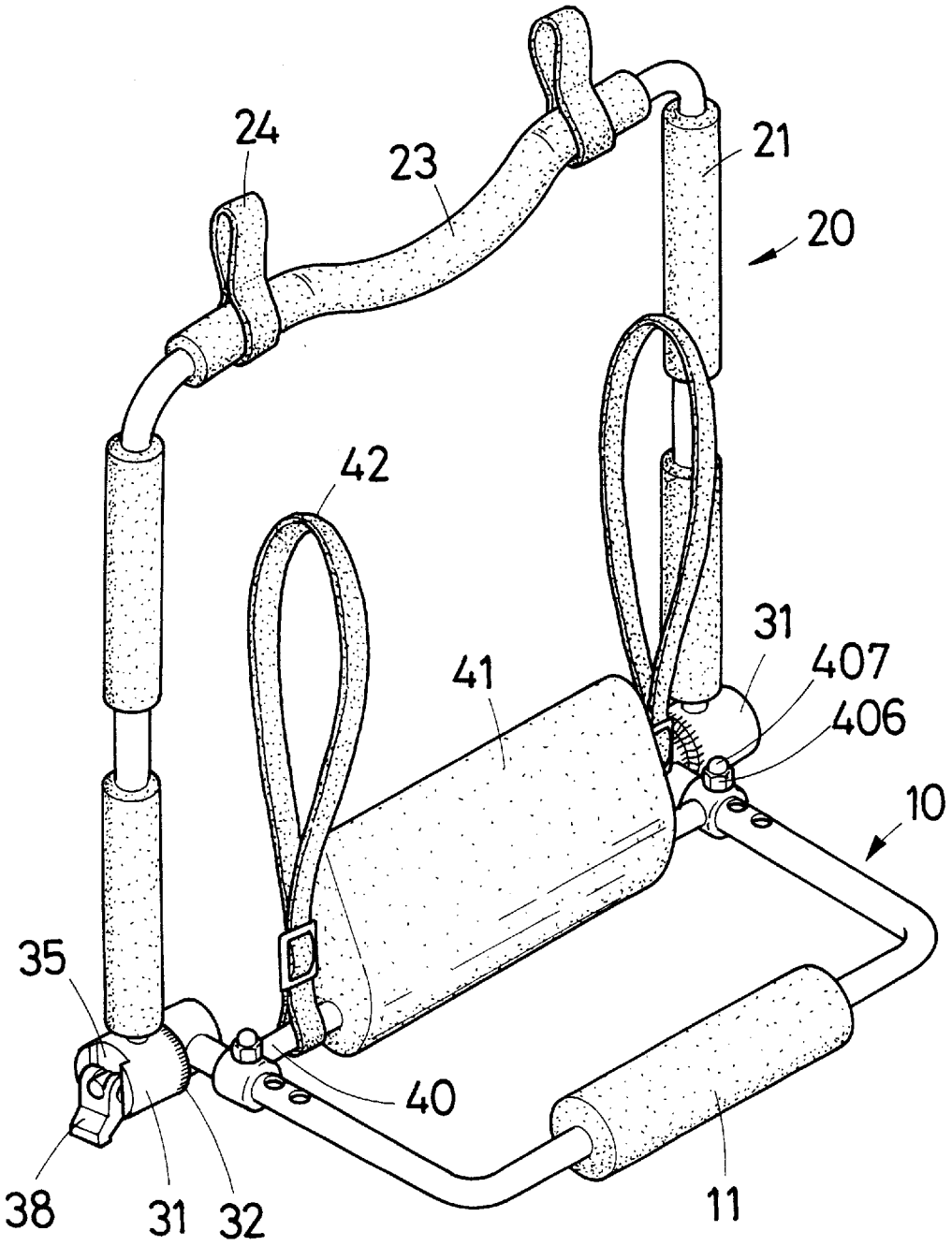
FIG. 1 is a perspective view of the present invention.
Figure 3:
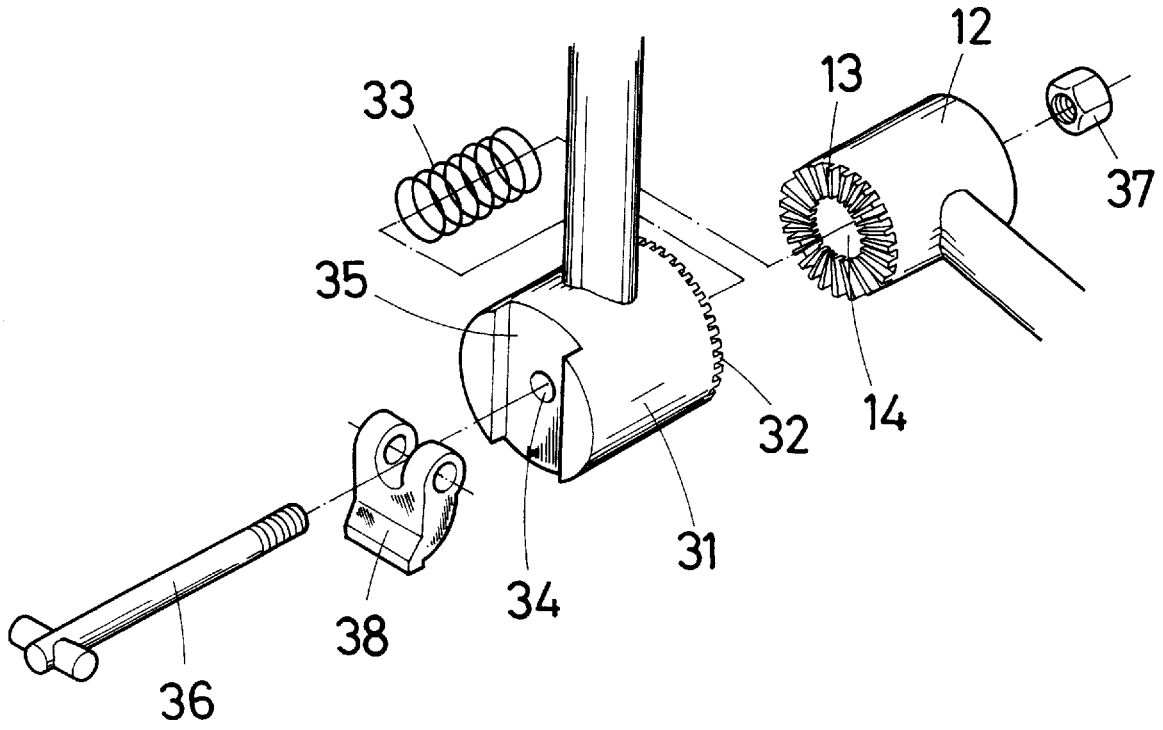
FIG. 3 is a fragmentary, exploded perspective view showing the angle-adjusting structure of the present invention.

Referring to FIG. 1, the present invention relates to a multipurpose exerciser suitable for doing abdominal exercises, rowing exercises, abdomen-compressing exercises, and chest and arm exercises. The multipurpose exercisers of the present invention include a primary and a secondary n-shaped frame 20, 10, respectively pivotally connected end to end, and an adjustable crossbar 40 movably connected and extended between the two ends of the secondary frame 10, near the two joints connecting the two n-shaped frames 10, 20. An outer or front part of the secondary n-shaped frame 10 is wrapped with a cylindrical foam rubber 11 or similarly suitable material. Two first positioning members 12, as shown in FIG. 3, are separately connected to the two rear ends of the secondary n-shaped frame 10. As shown in FIG. 3, each first positioning member 12 is formed around an outer end surface with a plurality of teeth 13 and at a central portion of the outer end surface with an axially extended hole 14.

Figure 2:
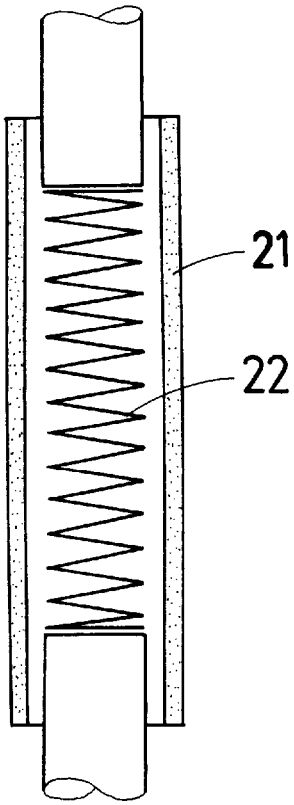
FIG. 2 is a fragmentary, enlarged and sectional view showing the primary n-shaped frame wrapped with foam rubber material and equipped with an internal connecting structure for the springs disposed therein.

Referring back to FIGS. 1 and 2, the primary n-shaped frame 20 is pivotally connected to two ends of the secondary n-shaped frame 10. Multiple pieces of foam rubber 21 are provided to wrap two sides of the primary n-shaped frame 20. As particularly shown in FIG. 2, the two side portions of the primary n-shaped frame 20 actually each includes an upper and a lower section interconnected by means of a first spring 22 disposed between them. The first spring 22 allows the two sections of each side portion of the primary n-shaped frame 20 to properly flex relative to each other when a force is applied on the primary n-shaped frame 20 and to return to their respective home positions after bending due to such flexibility.

Figure 4:
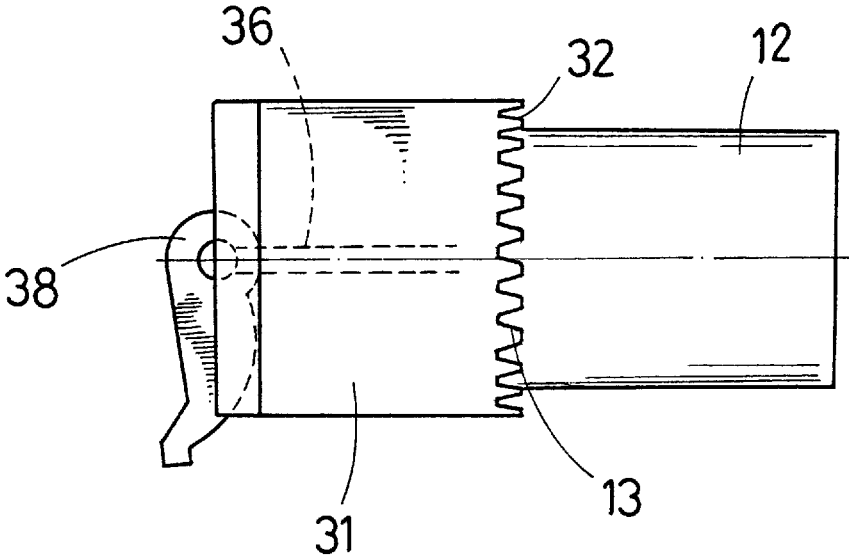
FIGS. 4 and 5 are side plan views of the assembled angle-adjusting structure of the present invention, showing the manner in which the structure operates.
Figure 5:
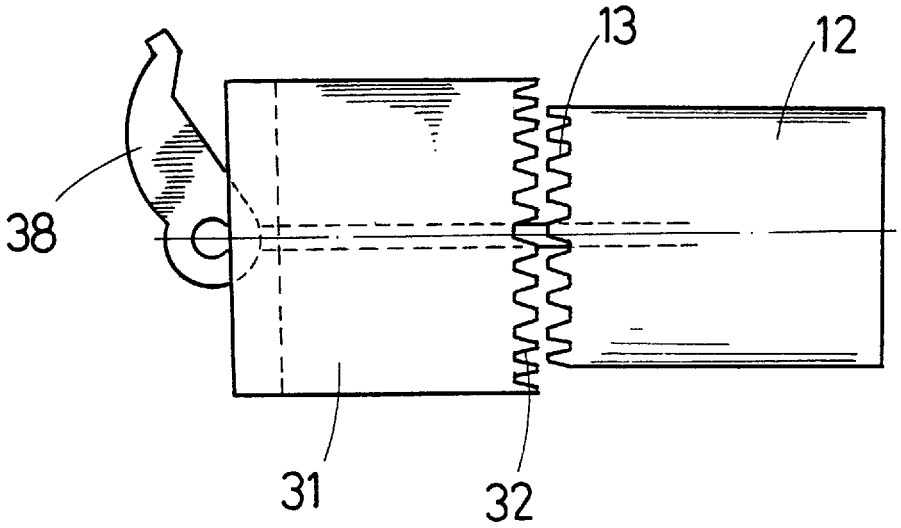

As shown in FIGS. 1 and 3, two second positioning members 31 are connected to two ends of the primary n-shaped frame 20. Each of the second positioning members 31 is formed around an inner end surface with a plurality of teeth 32 corresponding to the teeth 13 and at a central portion of the inner end surface with an axially extended hole (not shown) corresponding to the hole 14 of the first positioning member 12. A second spring 33 is disposed to extend between each hole 14 and the corresponding axial hole of the second positioning member 31. Another axially extended hole 34 is formed in an outer end surface of each second positioning member 31. A recess 35 is formed in a middle portion of the outer end surface of each second positioning member 31. An insertion pin 36 having a T-shaped outer head is inserted into and extends through the axially extended hole 34, the hole 14, and the second spring 33 at each side of the first and the second positioning members 12, 31. A nut 37 is screwed to a free end of each insertion pin 36 projecting from an inner end surface of a respective first positioning member 12, so that the pin 36 is fixedly located thereat. An eccentric member 38 is pivotally attached to the T-shaped head portion of each insertion pin 36, whereby, when the eccentric members 38 are pushed upward about the T-shaped head portion of the pins 36, as shown in FIG. 5, the two corresponding pairs of the first and the second positioning members 12, 31 are pushed away from each other for some distance. At this point, the corresponding first and second positioning members 12, 31 are allowed to be rotated relative to each other until each positioning member 12 or 31 at each side of the frames 10, 20 is rotated to a desired angularly inclined position. Then, the eccentric members 38 are pushed downward again, as shown in FIG. 4, so that the first and the second positioning members 12, 31 contact each other again with the toothed end surfaces 13, 32 meshed with one another, locating the secondary and the primary n-shaped frames 10, 20 at a position with the selected angle between them. Since the angle-adjusting structure, as shown in FIGS. 3, 4 and 5, is a known structure, it is not further described herein.

Referring back to FIG. 1 again, the primary n-shaped frame 20 is provided at a transverse top section with a handle 23 for gripping by a user. Near two outer ends of the handle 23 there are two hand loops 24. The adjustable crossbar 40 is connected and extended between two ends of the secondary n-shaped frames 10 and is wrapped at a middle portion with a piece of foam rubber cushion 41 serving as a pillow or cushion. Two loop-shaped straps 42 are separately attached to two outer ends of the foam rubber cushion 41 for putting around and fixing over different areas of the user for safety purposes during use of the exerciser.

Figure 6:
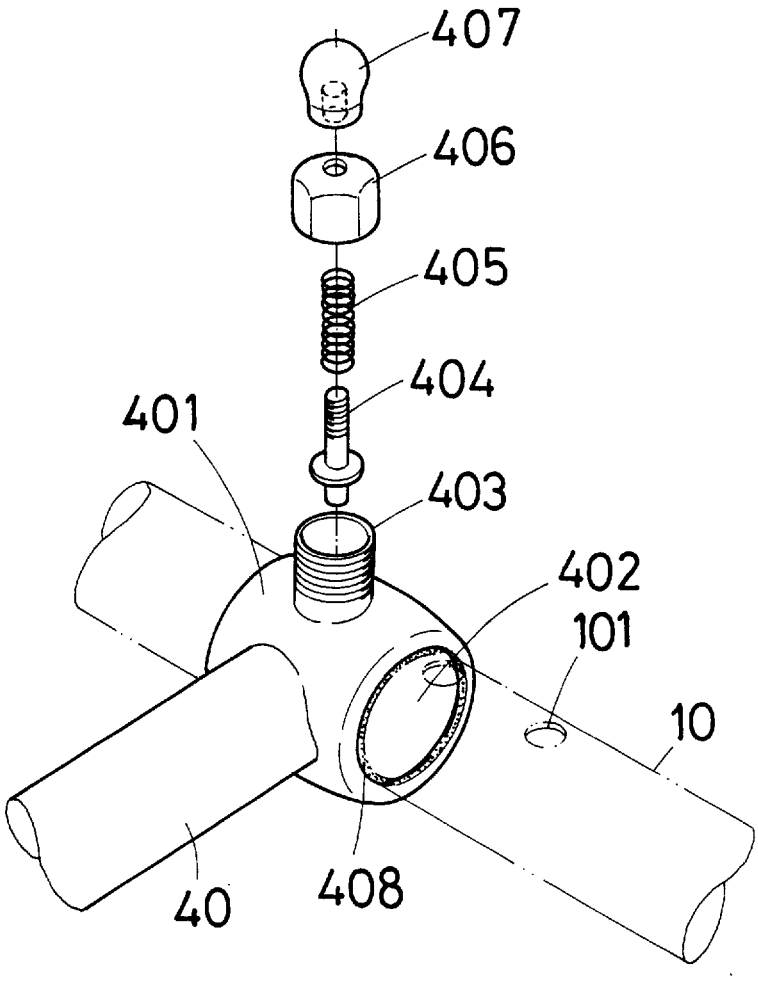
FIG. 6 is an enlarged, fragmentary, exploded perspective view of the adjustable cross bar of the present invention.

FIG. 6 refers to the structure of the adjustable crossbar 40. The adjustable crossbar 40 is connected for forward and backward movement on the secondary frame 10 and extended between the two ends of the secondary n-shaped frame 10. A hollow connecting member 401 having an axially extended connecting hole 402 is connected to each outer end of the adjustable crossbar 40. A receiving cylinder 403 projects upwardly from a top side of each connecting member 401 and is in open communication with the connecting hole 402. A bolt 404, a third spring 405, a fixing nut 406, and an adjusting knob 407 are sequentially disposed in the receiving cylinder 403 with a top end of the bolt 404 screwed into the adjusting knob 407 and a bottom end of the bolt 404 extending downwardly into one of the multiple adjusting holes 101 formed in the secondary n-shaped frame 10, near two ends thereof. When the two adjusting knobs 407 of the connecting members 401 are turned to draw the bolts 404 upwardly in the receiving cylinders 403 until the bottom ends of the bolts 404 disengage from the adjusting holes 101 of the secondary frame 10, the adjustable crossbar 40 is able to slide forward and backward on the secondary frame 10. Moreover, plastic bushings 408 are provided on an inner surface of the connecting members 401 as a buffer to make contact with the secondary n-shaped frame 10, so that the connecting members 401 are more durable even though they are frequently moved on the secondary frame 10.

Figure 7:
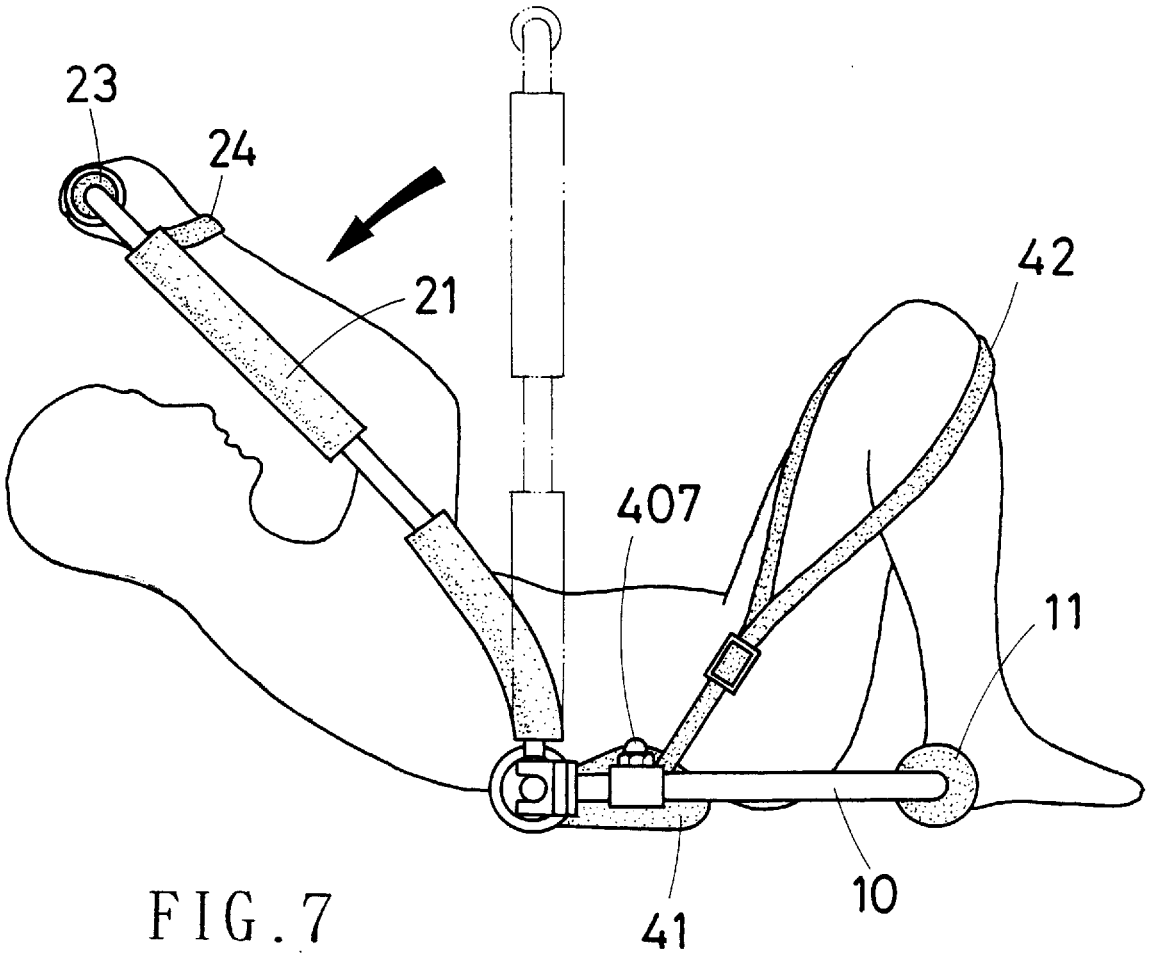
FIG. 7 illustrates the exerciser of the present invention being used to do an abdominal exercise.

FIG. 7 illustrates the manner in which the multipurpose exerciser of the present invention is used to do an abdominal exercise. As shown in the drawing, the secondary n-shaped frame 10 is horizontally positioned on the ground or floor with the primary n-shaped frame 20 fixed in a suitably inclined position relative to the secondary n-shaped frame 10. A user may lie on the exerciser with his or her back resting against the foam rubber cushion 41 of the adjustable crossbar 40 and the two straps 42 put over his or her knees. The user may grip the handle 23 with two hands extending through the two hand loops 24. Due to the suitably flexible first springs 22 connecting two sections of the side portions of the primary n-shaped frame 20, the primary n-shaped frame 20 is allowed to return to its original shape after it is pulled downward and bent toward the user.

Figure 8:
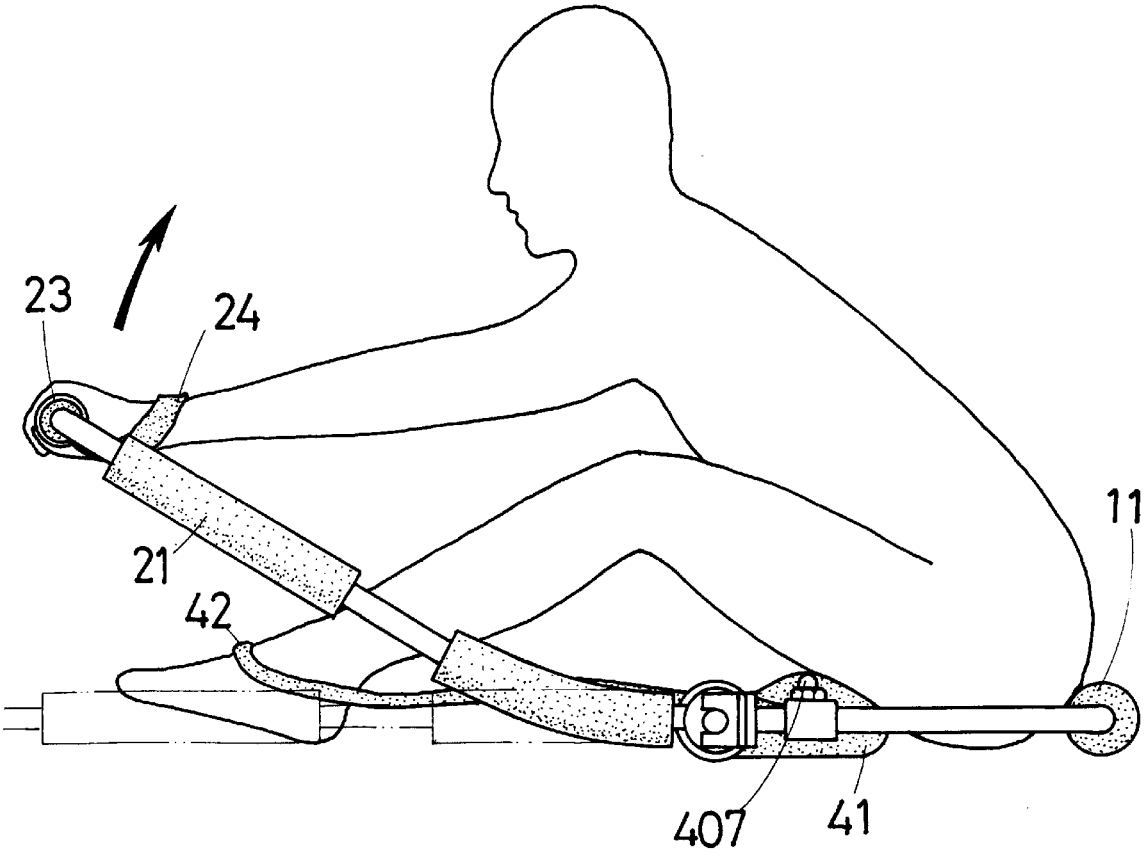
FIG. 8 illustrates the exerciser of the present invention being used to do a rowing exercise.

FIG. 8 illustrates the manner in which the multipurpose exerciser of the present invention is used to do a rowing exercise. As shown in the drawing, the secondary and the primary n-shaped frames 10, 20 are adjusted with a large angle between them. The user sits on the exerciser with his or her hip resting against the foam rubber material 11 and the straps 42 put around his or her ankles. Again, the user grips the handle 23 with two hands extended through the two hand loops 24, so that the primary n-shaped frame 20 can be pulled upward or pushed downward, just like rowing a boat.

Figure 9:
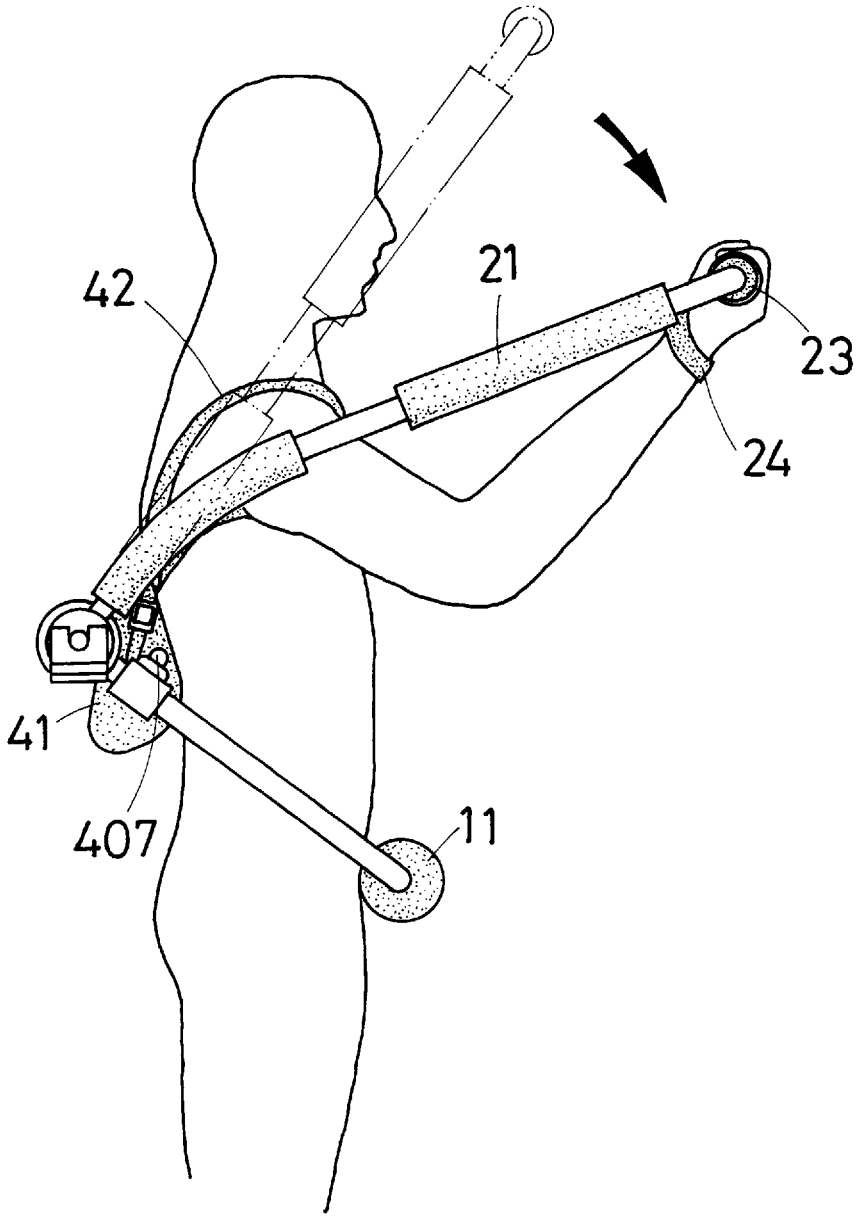
FIG. 9 illustrates the exerciser of the present invention being used to do an abdomen-compressing exercise.

FIG. 9 illustrates the manner in which the multipurpose exerciser of the present invention is used to do an abdomen-compressing exercise. As shown in the drawing, the secondary and the primary n-shaped frames 10 and 20 are adjusted so as to have an acute angle between them. The adjusted exerciser is positioned on the user's body with the body extending through the two frames 10, 20 and the two straps 42 put around the user's two shoulders. When the user grips the handle 23 and pulls the same downwardly, the front part of the secondary n-shaped frame 10 wrapped with the foam rubber 11 is pulled upwardly to tightly press against the user's abdomen and the adjustable crossbar 40 wrapped with the foam rubber cushion 41 presses against the user's back. When the straps 42 are adjusted to a different length, the secondary n-shaped frame 10 is allowed to land on a different area of the abdomen and to strengthen the abdominal muscles thereof.

Figure 10:
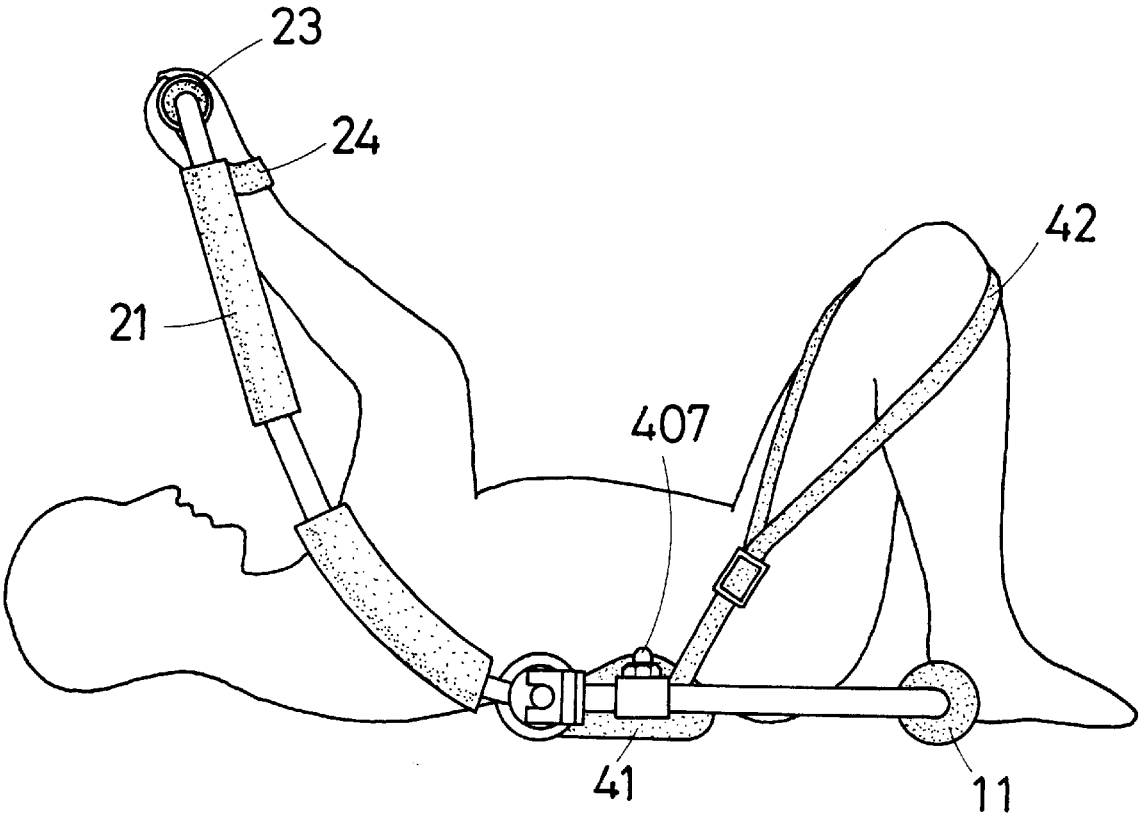
FIG. 10 illustrates the exerciser of the present invention being used to do a chest and arm exercise.

FIG. 10 illustrates the manner in which the multipurpose exerciser of the present invention is used to do a chest and arm exercise. As shown in the drawing, the secondary and the primary n-shaped frames 10, 20 are adjusted with an acute angle between them. The adjusted exerciser is positioned on the ground or floor with the secondary n-shaped frame 10 lying on the ground or floor. The user lies with their back on the exerciser and presses against the foam rubber cushion 41 with the two straps 42 put around their bent knees. Then, the user may grip the handle 23 and push the primary n-shaped frame 20 upwardly to strengthen his or her chest and arm muscles.

The exerciser of the present invention has very simple structure which can be used to perform many different exercises, including abdominal exercises, rowing exercises, abdomen-compressing exercises, chest and arm exercises, etc. It is a very practical and advantageous design.

What is claimed is:

1. A multipurpose exerciser, comprising:

a n-shaped secondary frame having a pair of opposing ends, said secondary frame having a multiplicity of adjustment holes formed adjacent each of said pair of opposing ends;

a n-shaped primary frame having a pair of opposing ends pivotally connected to respective opposing ends of said secondary frame, said primary frame having a pair of side sections wrapped with a layer of foam rubber and a handle portion extending between said pair of side sections with a layer of foam rubber wrapped thereon, each of said side sections having an upper section and a lower section interconnected by a spring disposed therebetween;

a pair of hand loops disposed on said handle portion of said primary frame adjacent opposing ends thereof;

a crossbar slidably coupled to said secondary frame adjacent said pair of opposing ends thereof, said crossbar including a pair of hollow connecting members respectively coupled to opposing ends thereof, each of said pair of hollow connecting members having (a) a first bore formed therethrough for receiving said secondary frame therein, (b) a receiving cylinder extending from an outer surface thereof and having a second bore formed therethrough and in open communication with said first bore, (c) a bolt disposed in said second bore and having a distal end releasably engageable with a selected one of said multiplicity of adjustment holes, (d) a spring disposed on said bolt for applying a bias force thereto, (e) a fixing nut threadedly coupled to said receiving cylinder and having an aperture formed therethrough for passage of a proximal end of said bolt therethrough, and (f) an adjustment knob threadedly engaged with said proximal end of said bolt; and, a pair loop-shaped straps coupled to said crossbar adjacent opposing ends thereof.

2. The multipurpose exerciser as recited in claim 1 where said secondary frame includes a front portion with a cylindrically shaped foam rubber layer.

3. The multipurpose exerciser as recited in claim 1 where said crossbar has a central portion having a foam rubber cushion disposed therein.

* * * * *